US006238044B1

(12) United States Patent
Silverbrook et al.

(10) Patent No.: US 6,238,044 B1
(45) Date of Patent: May 29, 2001

(54) PRINT CARTRIDGE

(75) Inventors: Kia Silverbrook, Balmain; Tobin Allen King, Cremorne; Garry Raymond Jackson, Haberfield, all of (AU)

(73) Assignee: Silverbrook Research PTY LTD, Balmain (AU)

( * ) Notice: Subject to any disclaimer, the term of this patent is extended or adjusted under 35 U.S.C. 154(b) by 0 days.

(21) Appl. No.: 09/607,993

(22) Filed: Jun. 30, 2000

(51) Int. Cl.[7] ..... B41J 2/175
(52) U.S. Cl. ..... 347/86; 347/87
(58) Field of Search ..... 347/85, 86, 87, 347/40, 42, 43, 102, 108

(56) References Cited

U.S. PATENT DOCUMENTS

| | | | |
|---|---|---|---|
| 4,223,324 | 9/1980 | Yamamori | 347/21 |
| 4,296,418 | 10/1981 | Yamazaki | 347/28 |
| 5,409,138 | 4/1995 | Nakano | 222/64 |
| 5,778,160 * | 7/1998 | Smith | 395/109 |
| 5,784,088 * | 7/1998 | Ujita et al. | 347/86 |
| 5,847,735 * | 12/1998 | Betschon | 347/86 |
| 6,048,055 | 4/2000 | Hakkaku | 347/86 |

FOREIGN PATENT DOCUMENTS

35820/99 1/2000 (AU) .

* cited by examiner

*Primary Examiner*—N. Le
*Assistant Examiner*—Anh T. N. Vo

(57) ABSTRACT

A print cartridge includes a support arrangement. A supply of print media and a supply of ink are arranged within the support arrangement. A filter is carried by the support arrangement for filtering air to be supplied to a printhead of a device in which the print cartridge is installed, in use.

13 Claims, 5 Drawing Sheets

PRINT CARTRIDGE

FIELD OF THE INVENTION

This invention relates to a print cartridge. More particularly, the invention relates to a print cartridge for use with an instantaneous print digital camera.

BACKGROUND OF THE INVENTION

Digital cameras are becoming increasingly popular with consumers for recording images. However, a problem exists with such digital cameras in that, to obtain a hard copy of a print of an image, the digital camera needs to be connected to a computer for printing out the print. The applicant has, in its co-pending U.S. patent application Ser. No. 09/112,783 filed Jul. 10, 1998 and entitled "Ink and media cartridge with axial ink chambers" proposed a replaceable cartridge for such digital cameras.

The digital camera makes use of a page width printhead. By "page width" is meant that the printhead prints one line at a time on the print media without traversing the print media, or rastering, as the print media moves past the printhead.

The printhead now under consideration makes use of a nozzle guard through which ink droplets are fired prior to being deposited on the print media. It is important to maintain the nozzle guard and the underlying printhead free of detritus. Accordingly, air is blown over the nozzle guard to inhibit the build up of contaminants on the nozzle guard or the printhead.

When the print media in the cartridge and supply of ink have been consumed, the cartridge itself is replaced. It is also important that the air blown over the nozzle guard and the printhead be clean and, accordingly, it is necessary to filter the air. If a dedicated, separate air filter were used, the applicant believes that this air filter would not be replaced regularly enough.

SUMMARY OF THE INVENTION

According to the invention, there is provided a print cartridge which includes

- a support arrangement;
- a supply of print media and a supply of ink arranged within the support arrangement; and
- a filtering means carried by the support arrangement for filtering air to be supplied to a printhead of a device in which the print cartridge is installed, in use.

The support arrangement may comprise a housing which defines a chamber in which the supply of print media and the supply of ink are accommodated.

The housing may define a receiving means, in the form of a compartment, alongside the chamber for receiving the filtering means.

The cartridge may include a carrier for carrying the filtering means, the carrier mating with the housing for locating the filtering means and the supply of print media and supply of ink with respect to the housing.

The filtering means may comprise a canister in which a filter medium is contained. The canister may be shaped to be received within the compartment of the housing, the compartment being closed off by the carrier. The canister may have one or more air inlets with an air outlet arranged in spaced relationship relative to the, or each, air inlet so that the air is drawn through the filter medium prior to being extracted via the air outlet of the canister. The carrier may include an opening which, in use, is in register with the air outlet of the canister through which air is drawn to be blown over the printhead and its nozzle guard.

The housing may define a slot in communication with the chamber through which print media is ejected, in use.

The print media may be in the form of a roll of print media carried on a former, the former being rotatably received in the chamber of the housing.

Thus, the cartridge may include a de-curling and drive means for de-curling the print media as it is fed from the roll and for driving the print media through the slot of the housing, the de-curling and drive means being arranged in the chamber intermediate the roll of print media and the slot. The de-curling and drive means may comprise a roller assembly having a drive roller, which is controlled by a mechanism controlling the printhead to synchronise movement of the media and printing thereon by the printhead, and at least one idler roller.

The driver roller may have a non-slip bearing means which bears against the media to inhibit slippage of the media as it is ejected from the housing.

The ink may be contained in a container mounted in the housing. The container may be a right circular cylindrical container with the former of the roll of print media being rotatably received about the container. The printhead of the device in which the print cartridge is installed may be a multi-colour printhead. Thus, the container may be divided into reservoirs, each for housing a different type or color of ink.

One end of the container may be closed off by an end cap with an opposed end being closed off by a pierceable sealing arrangement. The sealing arrangement may be accessible through the carrier. The sealing arrangement may include an outer film member which protects the sealing arrangement prior to use.

The carrier may carry an authentication means for authenticating that the cartridge is compliant and compatible with the device into which it is installed.

BRIEF DESCRIPTION OF THE DRAWINGS

The invention is now described by way of example with reference to the accompanying diagrammatic drawings in which.

DETAILED DESCRIPTION OF THE DRAWINGS

Figure 1:
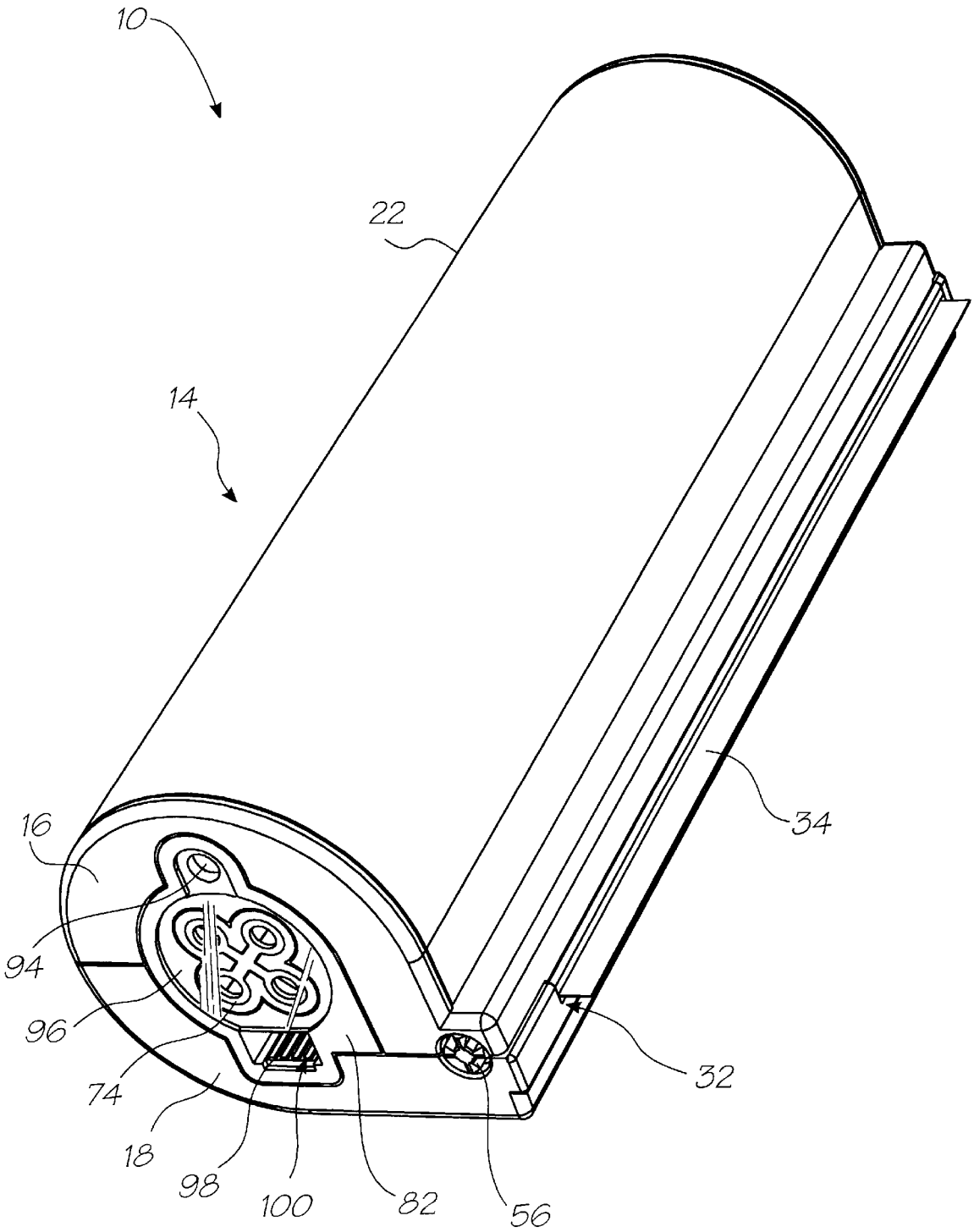
FIG. 1 shows a three dimensional view of a print cartridge, in accordance with the invention.

In the drawings, reference numeral 10 generally designates a print cartridge 10. The print cartridge 10 includes an ink cartridge 12, in accordance with the invention.

The print cartridge 10 includes a housing 14. As illustrated more clearly in FIG. 2 of the drawings, the housing 14 is defined by an upper molding 16 and a lower molding 18. The moldings 16 and 18 clip together by means of clips 20. The housing 14 is covered by a label 22 which provides an attractive appearance to the cartridge 10. The label 22 also carries information to enable a user to use the cartridge 10.

The housing 14 defines a chamber 24 in which the ink cartridge 12 is received. The ink cartridge 12 is fixedly supported in the chamber 24 of the housing 14.

A supply of print media 26 comprising a roll of film/media 34 wound about a former 28 is received in the chamber 24 of the housing 14. The former 28 is slidably received over the ink cartridge 12 and is rotatable relative thereto.

Figure 2:
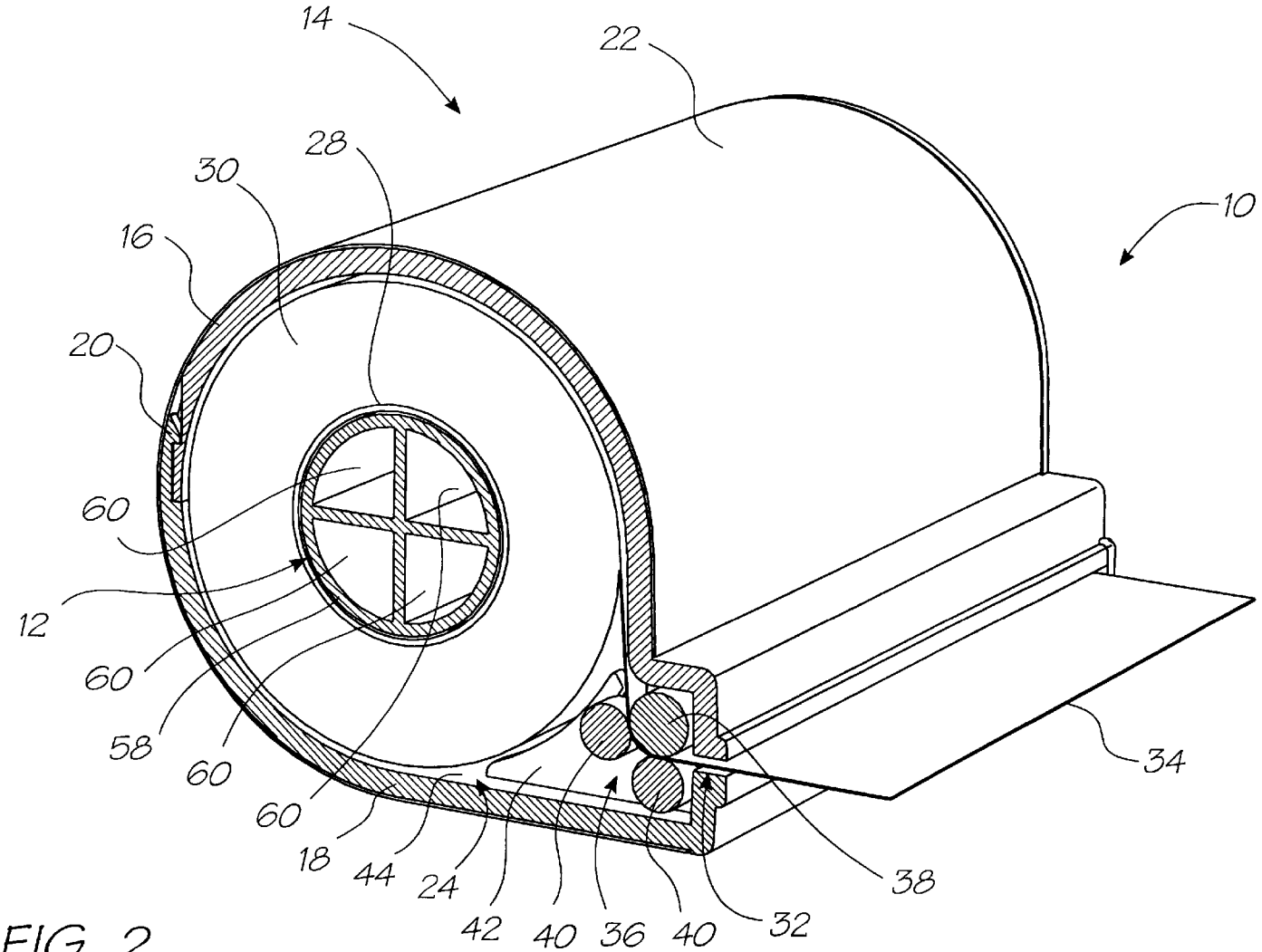
FIG. 2 shows a three dimensional, sectional view of the print cartridge.

As illustrated in FIG. 2 of the drawings, when the upper molding 16 and lower molding 18 are clipped together, an exit slot 32 is defined through which a tongue of the paper 34 is ejected.

The cartridge 10 includes a roller assembly 36 which serves to de-curl the paper 34 as it is fed from the roll 30 and also to drive the paper 34 through the slot 32. The roller assembly 36 includes a drive roller 38 and two driven rollers 40. The driven rollers 40 are rotatably supported in ribs 42 which stand proud of a floor 44 of the lower molding 18 of the housing 14. The rollers 40, together with the drive roller 38, provide positive traction to the paper 34 to control its speed and position as it is ejected from the housing 14. The rollers 40 are injection moldings of a suitable synthetic plastics material such as polystyrene. In this regard also, the upper molding 16 and the lower molding 18 are injection moldings of suitable synthetic plastics material, such as polystyrene.

The drive roller 38 includes a drive shaft 46 which is held rotatably captive between mating recesses 48 and 50 defined in a side wall of each of the upper molding 16 and the lower molding 18, respectively, of the housing 14. An opposed end 52 of the drive roller 38 is held rotatably in suitable formations (not shown) in the upper molding 16 and the lower molding 18 of the housing 14.

The drive roller 38 is a two shot injection molding comprising the shaft 46 which is of a high impact polystyrene and on which are molded a bearing means in the form of elastomeric or rubber roller portions 54. These portions 54 positively engage the paper 34 and inhibit slippage of the paper 34 as the paper 34 is fed from the cartridge 10.

The end of the roller 38 projecting from the housing 14 has an engaging formation in the form of a cruciform arrangement 56 (FIG. 1) which mates with a geared drive interface (not shown) of a printhead assembly of a device, such as a camera, in which the print cartridge 10 is installed. This arrangement ensures that the speed at which the paper 34 is fed to the printhead is synchronised with printing by the printhead to ensure accurate registration of ink on the paper 34.

The ink cartridge 12 includes a container 58 which is in the form of a right circular cylindrical extrusion. The container 58 is extruded from a suitable synthetic plastics material such as polystyrene.

In a preferred embodiment of the invention, the printhead with which the print cartridge 10 is used, is a multi-colored printhead. Accordingly, the container 58 is divided into a plurality of, more particularly, four compartments or reservoirs 60. Each reservoir 60 houses a different color or type of ink. In one embodiment, the inks contained in the reservoirs 60 are cyan, magenta, yellow and black inks. In another embodiment of the invention, three different colored inks, being cyan, magenta and yellow inks, are accommodated in three of the reservoirs 60 while a fourth reservoir 60 houses an ink which is visible in the infra-red light spectrum only.

Figure 3:
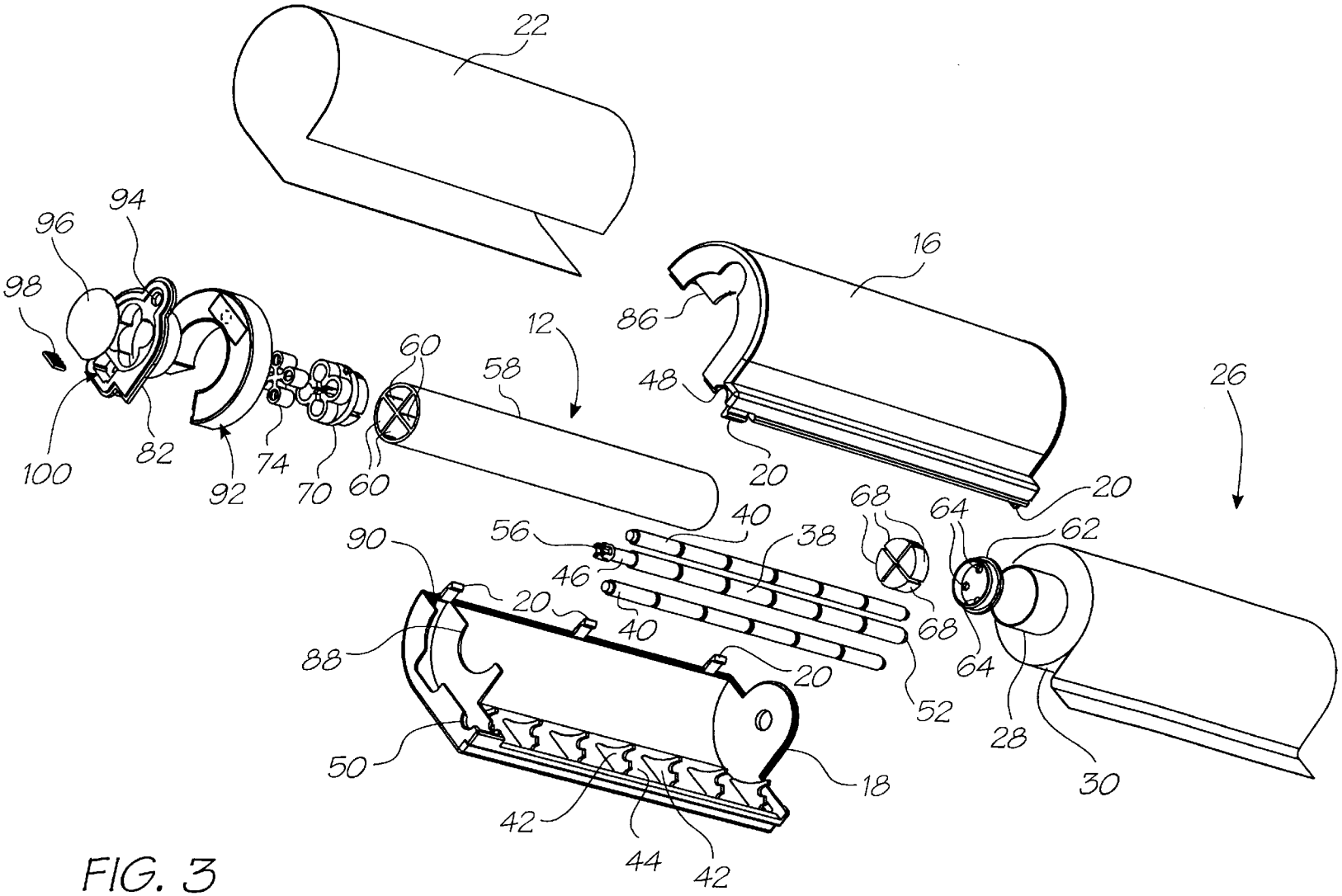
FIG. 3 shows a three dimensional, exploded view of the print cartridge.
Figure 4:
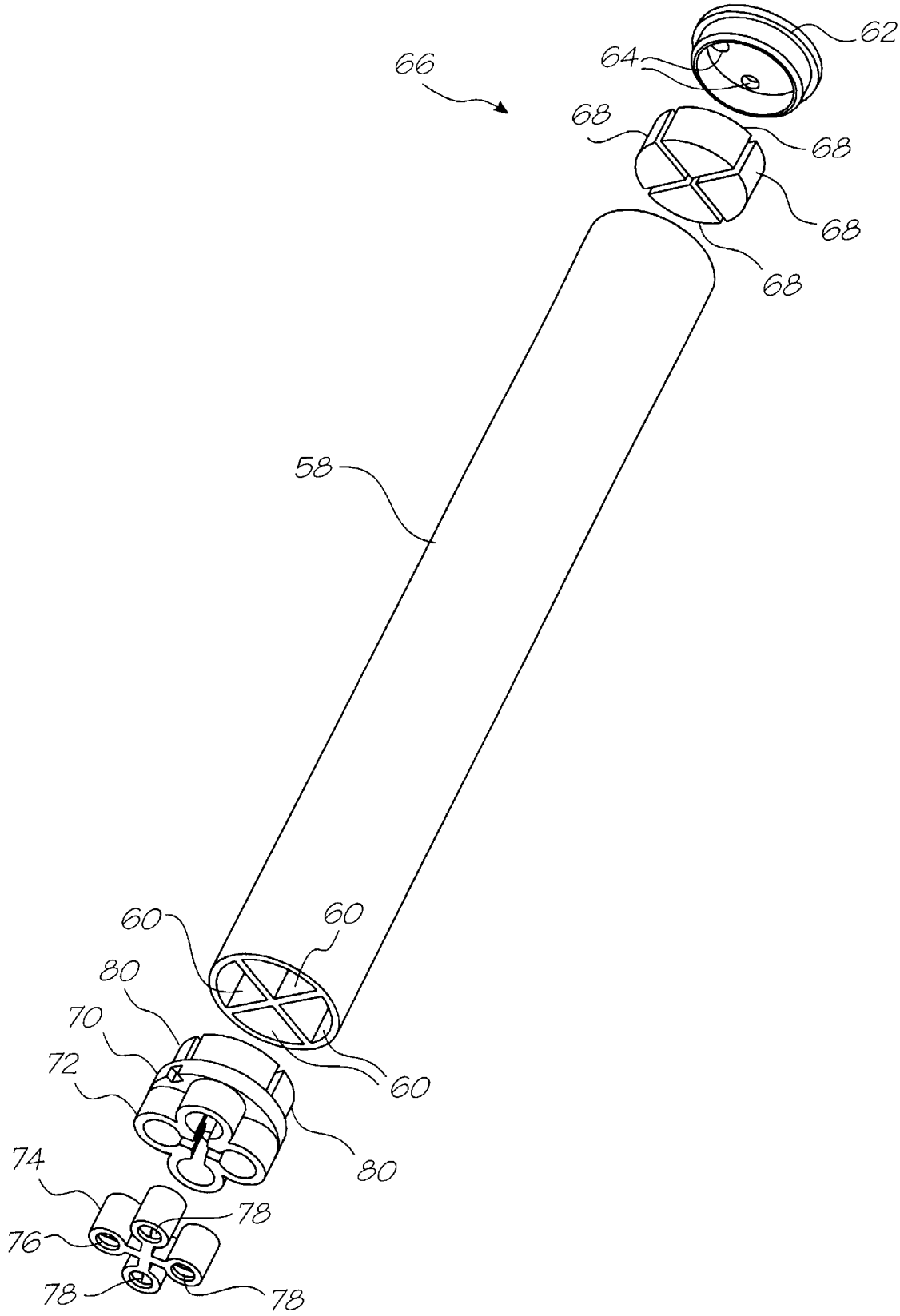
FIG. 4 shows a three dimensional, exploded view of an ink cartridge forming part of the print cartridge.

As shown more clearly in FIGS. 3 and 4 of the drawings, one end of the container 58 is closed off by an end cap 62. The end cap 62 has a plurality of openings 64 defined in it. An opening 64 is associated with each reservoir 60 so that atmospheric pressure is maintained in the reservoir 60 at that end of the container 58 having the end cap 62.

A seal arrangement 66 is received in the container 58 at the end having the end cap 62. The seal arrangement 66 comprises a quadrant shaped pellet 68 of gelatinous material slidably received in each reservoir 60. The gelatinous material of the pellet 68 is a compound made of a thermoplastic rubber and a hydrocarbon. The hydrocarbon is a white mineral oil. The thermoplastic rubber is a copolymer which imparts sufficient rigidity to the mineral oil so that the pellet 68 retains its form at normal operating temperatures while permitting sliding of the pellet 68 within its associated reservoir 60. A suitable thermoplastic rubber is that sold under the registered trademark of "Kraton" by the Shell Chemical Company. The copolymer is present in the compound in an amount sufficient to impart a gel-like consistency to each pellet 68. Typically, the copolymer, depending on the type used, would be present in an amount of approximately three percent to twenty percent by mass.

In use, the compound is heated so that it becomes fluid. Once each reservoir 60 has been charged with its particular type of ink, the compound, in a molten state, is poured into each reservoir 60 where the compound is allowed to set to form the pellet 68. Atmospheric pressure behind the pellets 68, that is, at that end of the pellet 68 facing the end cap 62 ensures that, as ink is withdrawn from the reservoir 60, the pellets 68, which are self-lubricating, slide towards an opposed end of the container 58. The pellets 68 stop ink emptying out of the container when inverted, inhibit contamination of the ink in the reservoir 60 and also inhibit drying out of the ink in the reservoir 60. The pellets 68 are hydrophobic further to inhibit leakage of ink from the reservoirs 60.

The opposed end of the container 58 is closed off by an ink collar molding 70. Baffles 72 carried on the molding 70 receive an elastomeric seal molding 74. The elastomeric seal molding 74, which is hydrophobic, has sealing curtains 76 defined therein. Each sealing curtain 76 has a slit 78 so that a mating pin (not shown) from the printhead assembly is insertable through the slits 78 into fluid communication with the reservoirs 60 of the container 58. Hollow bosses 80 project from an opposed side of the ink collar molding 70. Each boss 80 is shaped to fit snugly in its associated reservoir 60 for locating the ink collar molding on the end of the container 58.

Reverting again to FIG. 3 of the drawings, the ink collar molding 70 is retained in place by means of a carrier or fascia molding 82. The fascia molding 82 has a four leaf clover shaped window 84 defined therein through which the elastomeric seal molding 74 is accessible. The fascia molding 84 is held captive between the upper molding 16 and the lower molding 18 of the housing 14. The fascia molding 84 and webs 86 and 88 extending from an interior surface of the upper molding 16 and the lower molding 18 respectively, of the housing 14 define a compartment 90. An air filter 92 is received in the compartment 90 and is retained in place by the end molding 84. The air filter 92 cooperates with the printhead assembly. Air is blown across a nozzle guard of a printhead assembly to effect cleaning of the nozzle guard. This air is filtered by being drawn through the air filter 92 by means of a pin (not shown) which is received in an inlet opening 94 in the fascia molding 82.

Figure 5:
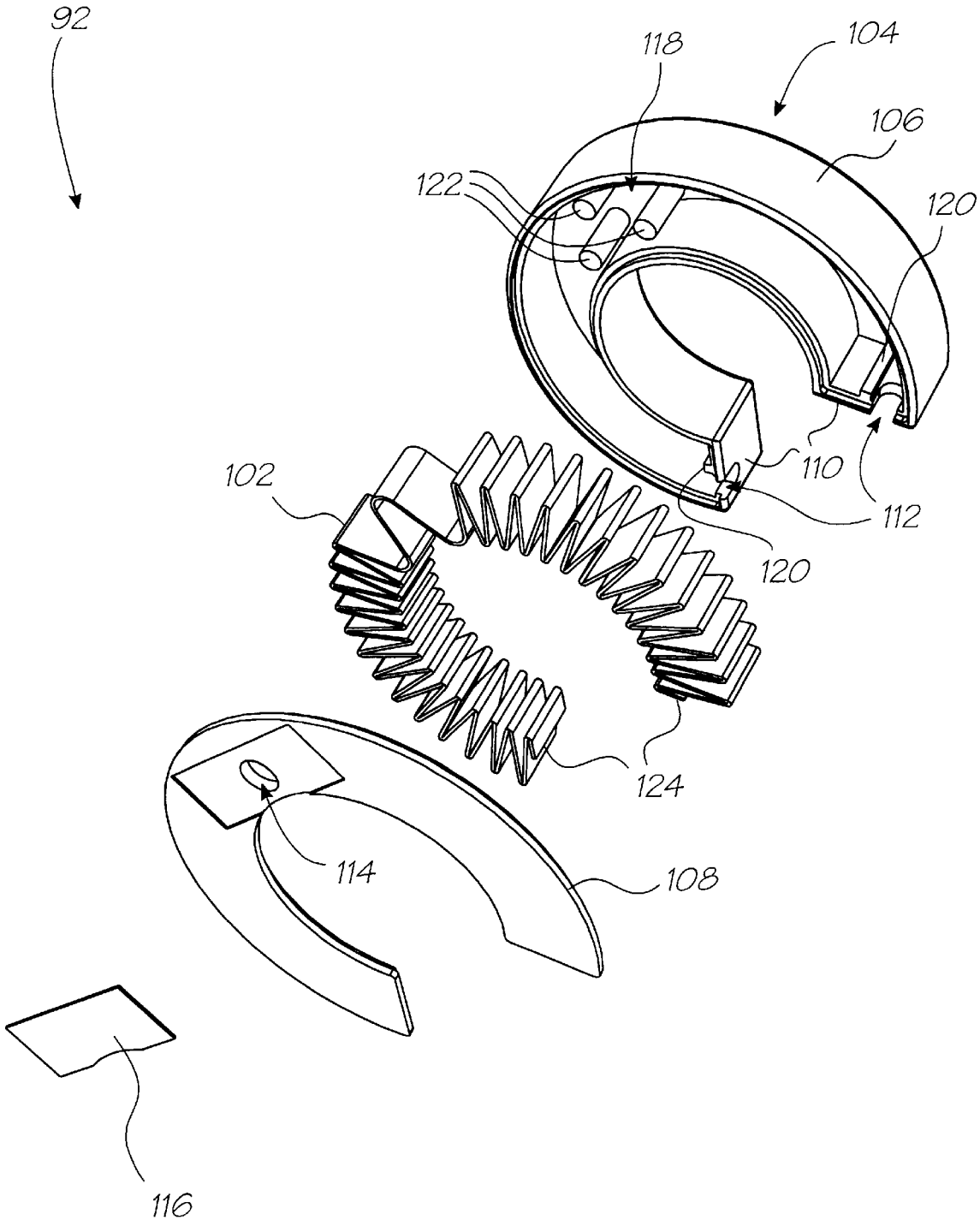
FIG. 5 shows a three dimensional view of an air filter of the print cartridge.

The air filter 92 is shown in greater detail in FIG. 5 of the drawings. The air filter 92 comprises a filter medium 102. The filter medium 102 is synthetic fibre based and is arranged in a fluted form to increase the surface area available for filtering purposes. Instead of a paper based filter medium 102 other fibrous batts could also be used.

The filter medium 102 is received in a canister 104. The canister 104 includes a base molding 106 and a lid 108. To be accommodated in the compartment 90 of the housing 14, the canister 104 is part-annular or horse shoe shaped. Thus, the canister 104 has a pair of opposed ends 110. An air inlet opening 112 is defined in each end 110.

An air outlet opening 114 is defined in the lid 108. The air outlet opening, initially, is closed off by a film or membrane 116. When the filter 92 is mounted in position in the compartment 90, the air outlet opening 114 is in register with the opening 94 in the fascia molding 82. The pin from the printhead assembly pierces the film 116 then draws air from the atmosphere through the air filter 92 prior to the air being blown over the nozzle guard and the printhead of the printhead assembly.

The base molding 104 includes locating formation 118 and 120 for locating the filter medium 102 in position in the canister 104. The locating formations 118 are in the form of a plurality of pins 122 while the locating formations 120 are in the form of ribs which engage ends 124 of the filter medium 102.

Once the filter medium 102 has been placed in position in the base mold 106, the lid 108 is secured to the base molding 106 by ultrasonic welding or similar means to seal the lid 108 to the base molding 106.

When the print cartridge 10 has been assembled, a membrane or film 96 is applied to an outer end of the fascia molding 82 to close off the window 84. This membrane or film 96 is pierced or ruptured by the pins, for use. The film 96 inhibits the ingress of detritus into the ink reservoirs 60.

An authentication means in the form of an authentication chip 98 is received in an opening 100 in the fascia molding 82. The authentication chip 98 is interrogated by the printhead assembly 98 to ensure that the print cartridge 10 is compatible and compliant with the printhead assembly of the device.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

We claim:

1. A print cartridge which includes a support arrangement, comprising a housing defining a chamber and a receiving means alongside the chamber;

a supply of print media and a supply of ink arranged within the chamber of the housing of the support arrangement; and a filtering means, received in the receiving means of the housing, for filtering air to be supplied to a printhead of a device in which the print cartridge is installed, in use.

2. The cartridge of claim 1 which further includes a carrier for carrying the filtering means, the carrier mating with the housing for locating the filtering means and the supply of print media and supply of ink with respect to the housing.

3. The cartridge of claim 2 in which the carrier carries an authentication means for authenticating the cartridge.

4. The cartridge of claim 1 in which the housing defines a slot in communication with the chamber through which print media is ejected, in use.

5. The cartridge of claim 4 in which the print media is in the form of a roll of print media carried on a tubular former, the former being rotatably received in the chamber of the housing.

6. The cartridge of claim 5 which includes a de-curling and drive means for de-curling the print media as it is fed from the roll and for driving the print media through the slot of the housing, the de-curling and drive means being arranged in the chamber intermediate the roll of print media and the slot.

7. The cartridge of claim 6 in which the de-curling and drive means comprises a roller assembly having a drive roller, which is controlled by a mechanism controlling the printhead to synchronise movement of the media and printing thereon by the printhead, and at least one idler roller.

8. The cartridge of claim 7 in which the drive roller has a non-slip bearing means which bears against the media to inhibit slippage of the media as it is ejected from the housing.

9. The cartridge as claimed in claim 5 in which the supply of ink comprises a container, containing ink, mounted in the housing.

10. The cartridge as claimed in claim 9 in which the container is a right circular cylindrical container with the former of the roll of print media being rotatably received about the container.

11. The cartridge of claim 9 in which the container is divided into reservoirs, each for housing a different type of ink.

12. The cartridge of claim 9 in which one end of the container is closed off by an end cap with an opposed end being closed off by a pierceable sealing arrangement.

13. The cartridge of claim 12 in which the sealing arrangement includes an outer film member.

* * * * *